US010859323B2

(12) United States Patent
Cheng

(10) Patent No.: US 10,859,323 B2
(45) Date of Patent: Dec. 8, 2020

(54) VAPOR CHAMBER AND MANUFACTURING METHOD FOR THE SAME

(71) Applicant: COOLER MASTER CO., LTD., New Taipei (TW)

(72) Inventor: Jen-Chih Cheng, New Taipei (TW)

(73) Assignee: Cooler Master Co., Ltd., New Taipei (TW)

( * ) Notice: Subject to any disclaimer, the term of this patent is extended or adjusted under 35 U.S.C. 154(b) by 77 days.

(21) Appl. No.: 16/430,672

(22) Filed: Jun. 4, 2019

(65) Prior Publication Data

US 2019/0376747 A1 Dec. 12, 2019

Related U.S. Application Data

(60) Provisional application No. 62/682,266, filed on Jun. 8, 2018.

(51) Int. Cl.
*F28D 15/00* (2006.01)
*F28D 15/04* (2006.01)
*F28D 15/02* (2006.01)

(52) U.S. Cl.
CPC ..... *F28D 15/046* (2013.01); *F28D 15/0233* (2013.01); *F28F 2210/10* (2013.01); *F28F 2230/00* (2013.01)

(58) Field of Classification Search
CPC ..... F28D 15/046; F28D 15/0233; F28F 2210/10; F28F 2230/00
USPC ..... 165/104.26
See application file for complete search history.

(56) References Cited

U.S. PATENT DOCUMENTS

2004/0104012 A1* 6/2004 Zhou ..... H01L 23/4275 165/104.26
2005/0173098 A1* 8/2005 Connors ..... F28D 15/0233 165/104.33
2017/0347489 A1* 11/2017 Lan ..... F28D 15/0233

FOREIGN PATENT DOCUMENTS

CN 102706193 A 10/2012
CN 107764118 A 3/2018
TW I618907 B 3/2018

* cited by examiner

*Primary Examiner* — Davis D Hwu
(74) *Attorney, Agent, or Firm* — Rosenberg, Klein & Lee

(57) ABSTRACT

A vapor chamber has upper and lower casings and a wick structure therebetween. The upper and lower casings have upper and lower heat exchange chamber areas having multiple upper and lower surface features thereon, separated by multiple upper and lower vapor areas therebetween, respectively. The upper and lower heat exchange chamber areas are surrounded by walls, having flat rims, respectively. The height of the upper surface features is greater than the height of the lower surface features, whereby a top surface of the wick structure lies flush with the lower flat rim. The upper and lower heat exchange chamber areas form a vacuum chamber. An airtight sealed connection is formed at the flat rims of the surrounding walls of the upper and lower heat exchange chamber areas.

20 Claims, 10 Drawing Sheets

VAPOR CHAMBER AND MANUFACTURING METHOD FOR THE SAME

The present application claims priority to U.S. provisional application No. 62/682,266, filed on Jun. 8, 2018, the content of which is hereby incorporated by reference in its entirety.

BACKGROUND OF THE INVENTION

1. Field of the Invention

The present application relates generally to the field of heat transfer and, more particularly, to thermal management of computers or electronic devices.

2. Description of Related Art

During operation of a computer or electronic device, the heat that is created inside of a CPU or other processing unit must be carried away fast and efficiently to keep temperatures within design ranges specified by manufacturers. As CPUs and other processing units become lighter, smaller, and more powerful, more heat is generated in smaller spaces, making thermal management a greater challenge than before.

Thermal management techniques that have been developed for the cooling of CPUs and other processing units employ air-cooling systems and liquid heat exchange systems, among others. Vapor chambers, a type of planar heat pipe, can also be employed individually, or in conjunction with thermal management systems for heat spreading and isothermalizing.

Vapor chambers are vacuum containers that carry heat by evaporation of a working substance, which is spread by a vapor flow filling the vacuum. The vapor flow eventually condenses over cooler surfaces, and, as a result, the heat is distributed from an evaporation surface (heat flux source interface) to a condensation surface (cooling surface). Thereafter, condensed fluid flows back toward the evaporation surface. A wick structure is often used to facilitate the flow of the condensed fluid back to the evaporation surface, keeping it wet for large heat fluxes.

Generally, for vapor chambers to effectively spread heat via the phase change (liquid-vapor-liquid) mechanism which occurs at near isothermal conditions, the area of the cooling surfaces should be larger than the evaporating surfaces, the design of the vapor chambers should hinder deformation and leakage and heat-transmitting efficiency of the vapor chamber should be at the highest. This becomes more difficult to accomplish as CPUs and other processing units become lighter, smaller, and more powerful, generating more heat in smaller spaces, while concurrently not sacrificing maximum heat transport capacity, resulting in deformation of outer surfaces and resulting in leakage, all of which can cause dry-out.

To overcome the shortcomings, the present invention tends to provide a vapor chamber to mitigate or obviate the aforementioned problems.

SUMMARY OF THE INVENTION

The main objective of the invention is to provide a vapor chamber and a manufacturing method for the same.

The vapor chamber is under vacuum and has a working substance having an upper casing, a lower casing, and a wick. The upper casing has an upper first surface and an upper second surface. The upper second surface has an upper heat exchange chamber area having multiple upper surface features separated by multiple upper vapor areas, surrounded by walls having a flat rim. The lower casing has a first surface and an opposite second surface. The second surface has a lower heat exchange chamber area having multiple lower surface features separated by multiple lower vapor areas, surrounded by walls having a flat rim. The wick structure is disposed between and in contact with the upper surface features and the lower surface features of the upper casing and the lower casing, respectively. The upper and lower heat exchange chamber areas form a chamber having the wick structure disposed therebetween and the working substance therein and an airtight sealed connection is formed at the flat rims of the surrounding walls of the upper and lower heat exchange chamber areas.

Other objects, advantages and novel features of the invention will become more apparent from the following detailed description when taken in conjunction with the accompanying drawings.

BRIEF DESCRIPTION OF THE DRAWINGS

FIG. 3A is a perspective view of a lower casing of the vapor chamber in

FIG. 2;

FIG. 6A is a perspective view of an upper casing of the vapor chamber in

FIG. 5;

DETAILED DESCRIPTION OF PREFERRED EMBODIMENT

Figure 1A:
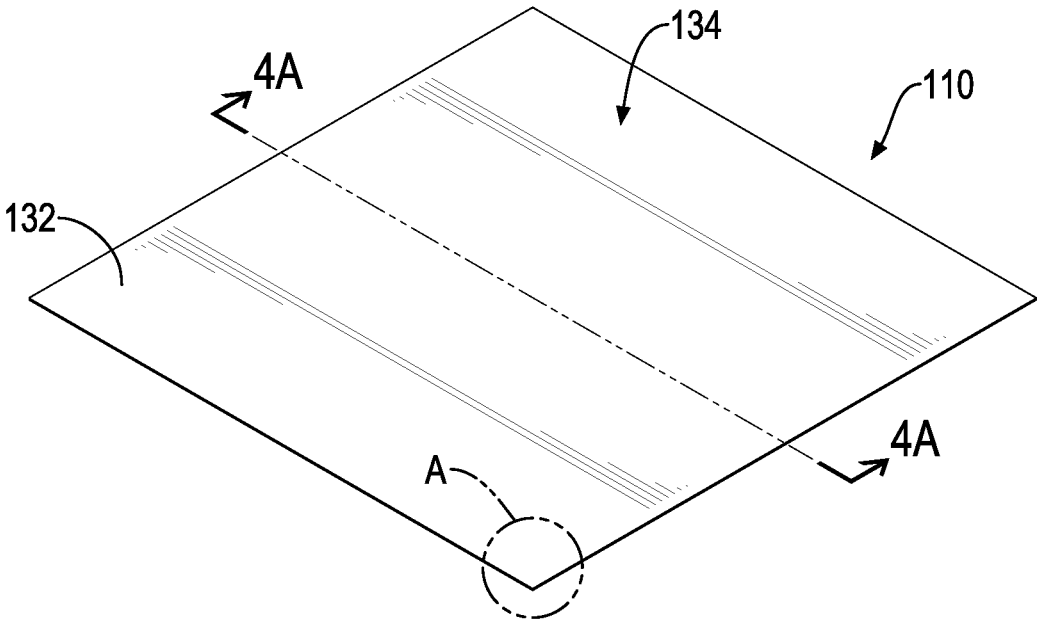
FIG. 1A is a perspective view of a first embodiment of a vapor chamber in accordance with the present invention.
Figure 1B:
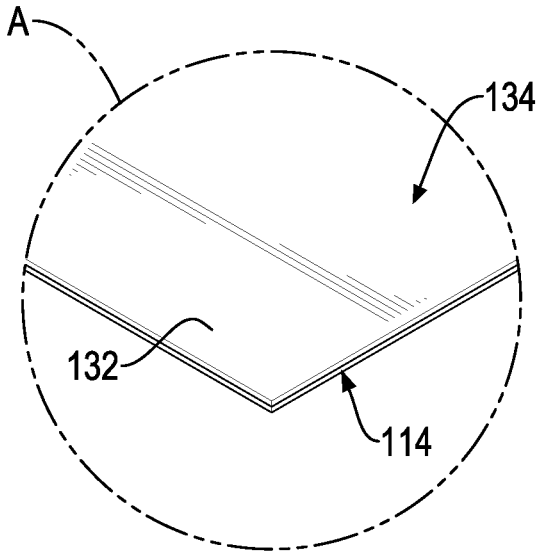
FIG. 1B is an enlarged perspective view of a corner section C of the vapor chamber in FIG. 1A.

With reference to FIGS. 1A, 1B, 2, 3A, and 3B the vapor chamber 110 in accordance with the present invention is rectilinear in shape and comprises an upper casing 134, a lower casing 114, and a wick structure 125 disposed therebetween. The upper and lower casings 134, 114 each comprise a first surface 132, 112 and a second surface 138, 118, respectively. The first surfaces 132, 112 are adaptable to be in thermal contact with a thermal load from a heat flux source, preferably, the first surface 112 of the lower casing 114. The second surfaces 138, 118 each comprise a heat exchange chamber area 139, 119 surrounded by walls having a flat rim 136, 116, respectively. Each of the heat exchange chamber areas 139, 119 is rectilinear in shape and comprises multiple lower surface features 140, 120 therein, separated by multiple vapor areas 142, 122, respectively. As an example, and not to be limiting, the upper and lower casings 134, 114 of the vapor chamber 110 are preferably made of a heat conducting material having a relatively high thermal conductivity such as copper or aluminum with flat first surfaces 132, 112 for abutting a free surface of an air-cooling system or liquid heat exchange system or a heat generating component such as a CPU or other processing unit, respectively. As an example, and not to be limiting, the lower surface features 140, 120 and the flat rims 136, 116 of the heat exchange chamber areas 139, 119 of the upper and lower casings 134, 114, respectively, may be integrally formed, by stamping or other methods known to those skilled in the art, or separately formed, and attached by diffusion bonding, thermal pressing, soldering, brazing or adhesive joining or other methods known to those skilled in the art, or any combination thereof. As an example, and not to be limiting, the wick structure 125 is preferably made of a material having a geometric structure, which is conducive to enhancing the flow of the working substance due to capillary forces such as a metal mesh, porous plate, and foam plate, preferably a metal mesh. Another function of the wick structure 125 is to promote and enhance boiling of the working substance adjacent to the heat flux source. As an example, and not to be limiting, the working substance can comprise distilled, de-ionized water, methanol, and acetone. As an example, and not to be limiting, the lower surface features 140, 120 can comprise one or more of posts, supports, poles, columns, pillars, protrusions, bulges, bumps, protuberances, textured surfaces, segmented elements, and staggered elements and are preferably made of a heat conducting material having a relatively high thermal conductivity such as copper or aluminum. As an example, and not to be limiting, the multiple vapor areas 142, 122 can comprise one or more of channels, canals, passageways, paths, networks, ducts, gutters, grooves, furrows, troughs, trenches, culverts, cuts, spillways, ditches, drains and conduits.

In the embodiments, the heat exchange chamber areas 139, 119 of the second surfaces 138, 118 of the upper and lower casings 134, 114, form an airtight vacuum chamber, having the wick structure 125 disposed therebetween and a working substance therein.

Figure 4A:
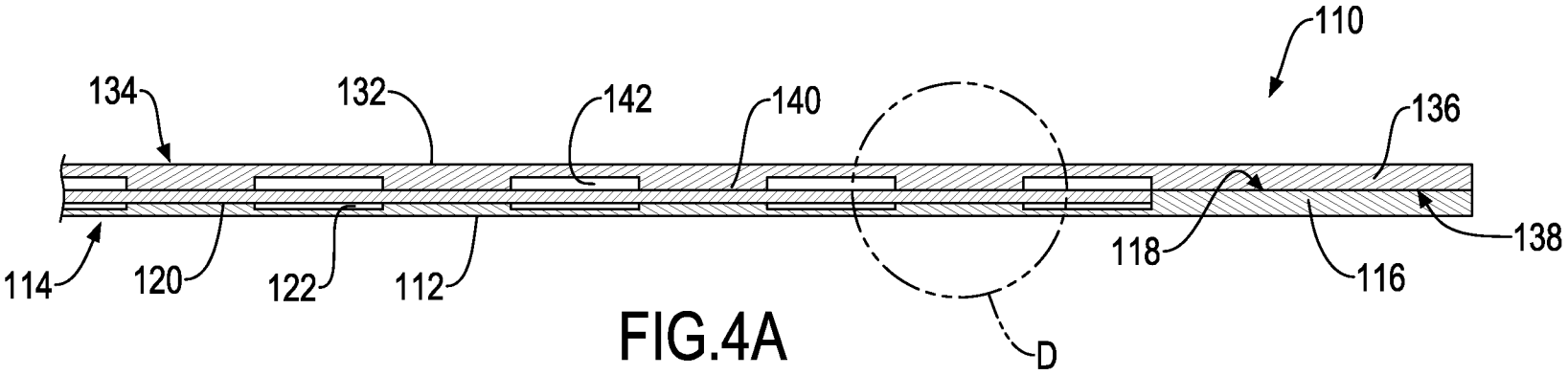
FIG. 4A is a cross-sectional side view of the vapor chamber along the line 4A-4A in FIG. 1.
Figure 4B:
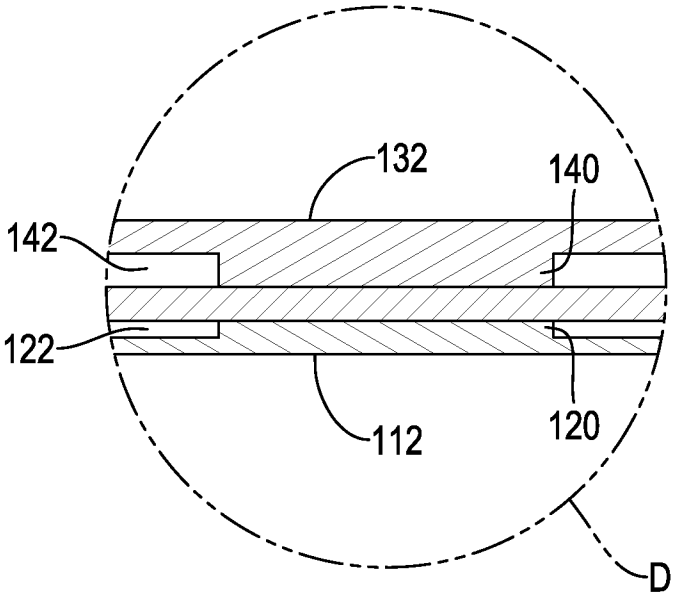
FIG. 4B is an enlarged cross sectional side view of a section D of the vapor chamber of FIG. 4A.
Figure 5:
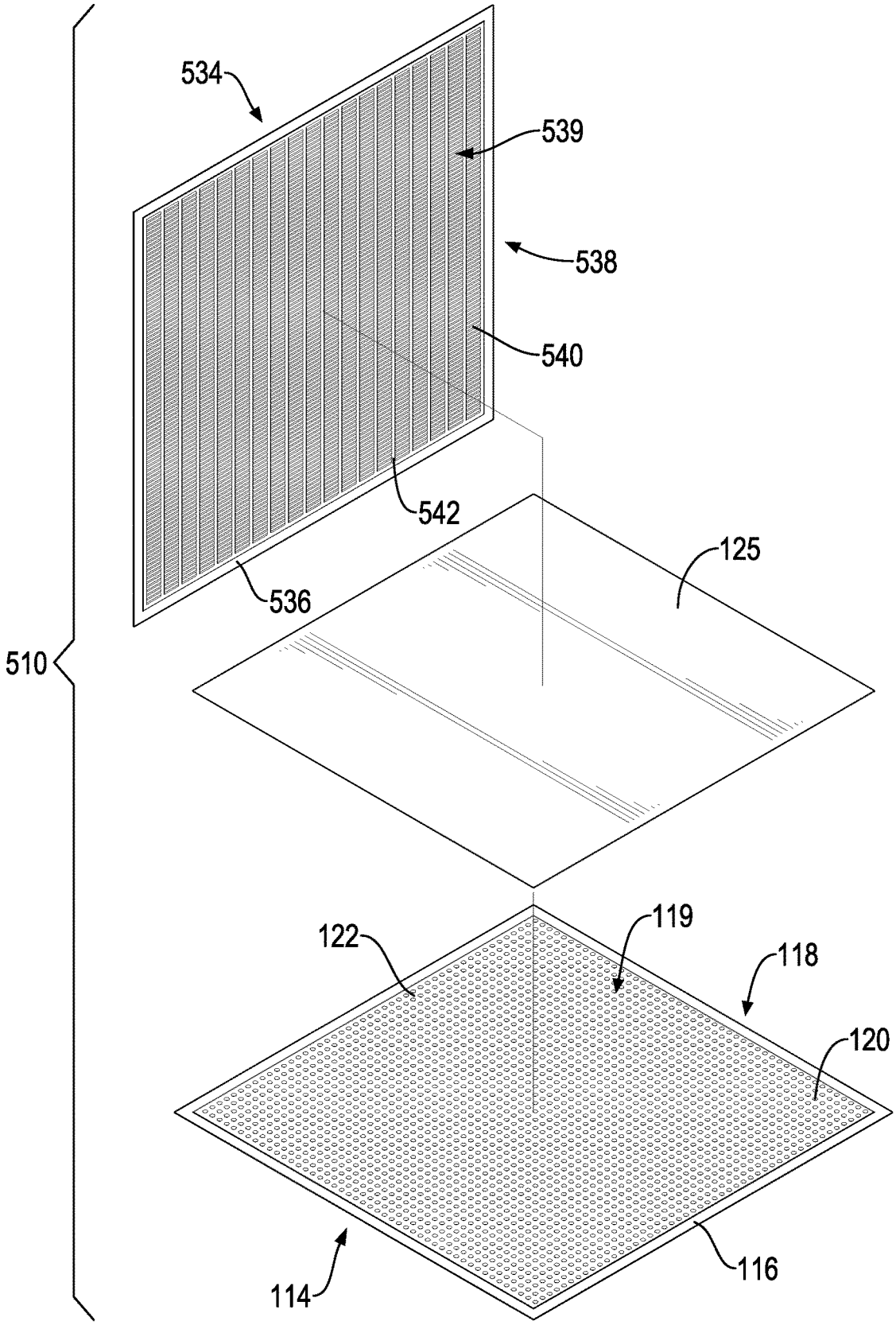
FIG. 5 is an exploded perspective view of a second embodiment of a vapor chamber in accordance with the present invention.
Figure 6A:
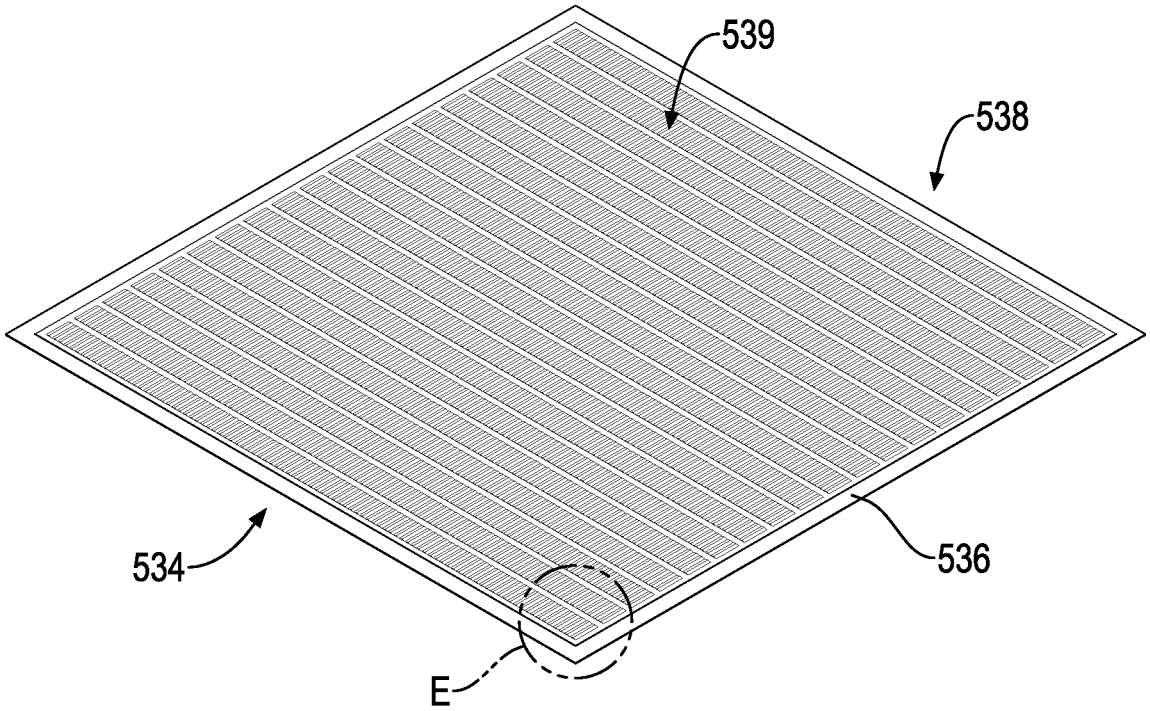
Figure 6B:
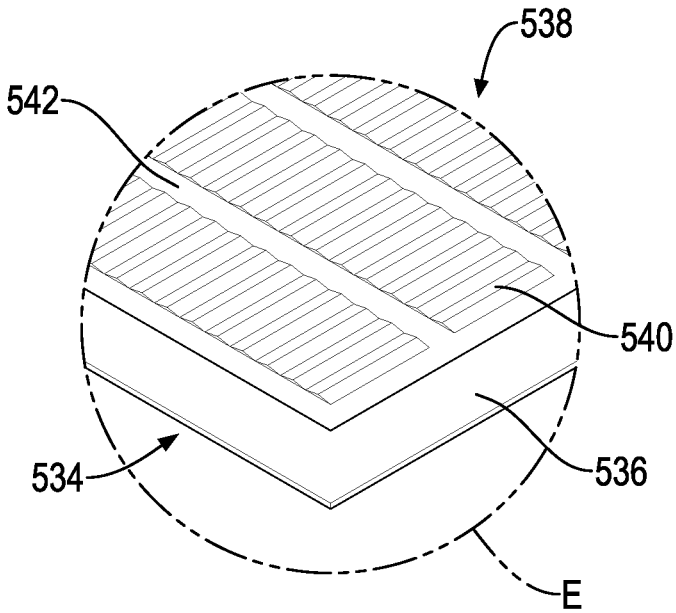
FIG. 6B is an enlarged perspective view of a corner section E of the upper casing in FIG. 6A.

With further reference to FIGS. 4A and 4B, the upper and lower casings 134, 114 of the vapor chamber 110 form a seamless airtight sealed connection at the flat rims 136, 116 of the surrounding walls of the heat exchange chamber areas 139, 119, respectively. In the embodiment, the outer and inner edges and walls of the upper and lower casings 134, 114 are aligned flush. As an example, and not to be limiting, the airtight sealed connection can be formed by diffusion bonding, thermal pressing, soldering, brazing or adhesive joining or other methods known to those skilled in the art. Also, as an example, and not to be limiting, a separate edge sealing material of various compositions can also be employed to ensure airtight sealing of the outer edges of the upper and lower casings 134, 114 such as an epoxy polymer material or other materials known to those skilled in the art.

In an embodiment, the shape and size of the lower surface features 140, 120 and corresponding vapor areas 142, 122 of the upper and lower casings 134, 114 are similar. In the embodiment, the lower surface features 140, 120 are evenly distributed columns, respectively. The diameters of the columns are the same size and are less than the width of the flat rims 136, 116 of the surrounding walls of the heat exchange chamber areas 139, 119, respectively. The main difference between the lower surface features 140, 120 of the upper and lower casings 134, 114 is that the height of the upper surface features 140 of the upper casing 134 is in line with and along a same surface plane as the flat rim 136 of the surrounding walls of the heat exchange chamber area 132 and the height of the lower surface features 120 of the lower casing 114 is not. In the embodiment, the wick structure 125 is positioned within the heat exchange chamber area 119 of the lower casing 114 and a top surface thereof is in line with and along a same surface plane as the flat rim 116 of the surrounding walls of the heat exchange chamber area 119. Correspondingly, the height of the lower surface features 120 of the lower casing 114 is less than the lateral surface plane of the flat rim 116, and is equal to the height of the surrounding walls of the heat exchange chamber area 119 minus the thickness of the wick structure 125. In the embodiment, the wick structure 125 sits flatly upon the lower surface features 120 of the lower casing 114 with its periphery walls lying flush with the surrounding walls of the heat exchange chamber area 119. In the embodiment, the working substance is disposed within the vapor area 122 of the lower casing 114 and can communicate with the vapor area 142 of the upper casing 134.

In the embodiment, a high heat flux source is applied to the first surface 112 of the lower casing 114 of the vapor chamber 110 and vaporizes the working substance. The vapor spreads throughout the entire internal volume of the vapor areas 142, 122 and condenses over cooler surfaces such as the inner walls of the second surface 138 of the upper casing 134. A wick structure 125 sits flatly upon the lower surface features 120 of the lower casing 114 with its periphery walls lying flush with the surrounding walls of the heat exchange chamber area 119, pumping the condensed fluid back to the heat flux source via capillary action.

The vapor chamber 110 is a rectangular, highly effective, and two-dimensional heat spreader with effective thermal conductivities. The upper casing 134 increases the area of the cooling surfaces for effective spreading of heat via the phase change (liquid-vapor-liquid) mechanism. Additionally, the upper and lower surface features 140, 120 of the upper and lower casings 134, 114 not only function as structural supports which hinder the deformation of the first surfaces, respectively 132, 112 or leakage between the flat rims 136, 116 of the surrounding walls of the heat exchange chamber areas 139, 119, which cause dry-out, they also function as backflow accelerators or arteries, accelerating backflow velocity of the condensed liquid to the wick structure 125 and working liquid via increased surface area. Lastly, the wick structure 125 is positioned in the middle of the vapor chamber 110 to further mitigate dry-out by facilitating the flow of the condensed liquid back to the evaporation surface keeping it wet for large heat fluxes. Because the backflow velocity of the working substance is increased by the plurality of upper and lower surface features 140, 120, in addition to hindrance of deformation and leakage, and positioning and functioning of the wick structure 125 to further facilitate flow of the condensed liquid back to the evaporation surface, all assisting to mitigate dry-out, the heat-transmitting efficiency of the vapor chamber 110 is increased.

In the embodiment, the shape and size of the lower surface features 140, 120 and corresponding vapor areas 142, 122 of the upper and lower casings 134, 114 are similar. However, the embodiments are not limited thereto, and the shape and size of the plurality of lower surface features 140, 120 and corresponding vapor areas 142, 122 of the upper and lower casings 134, 114 may be different.

Figure 2:
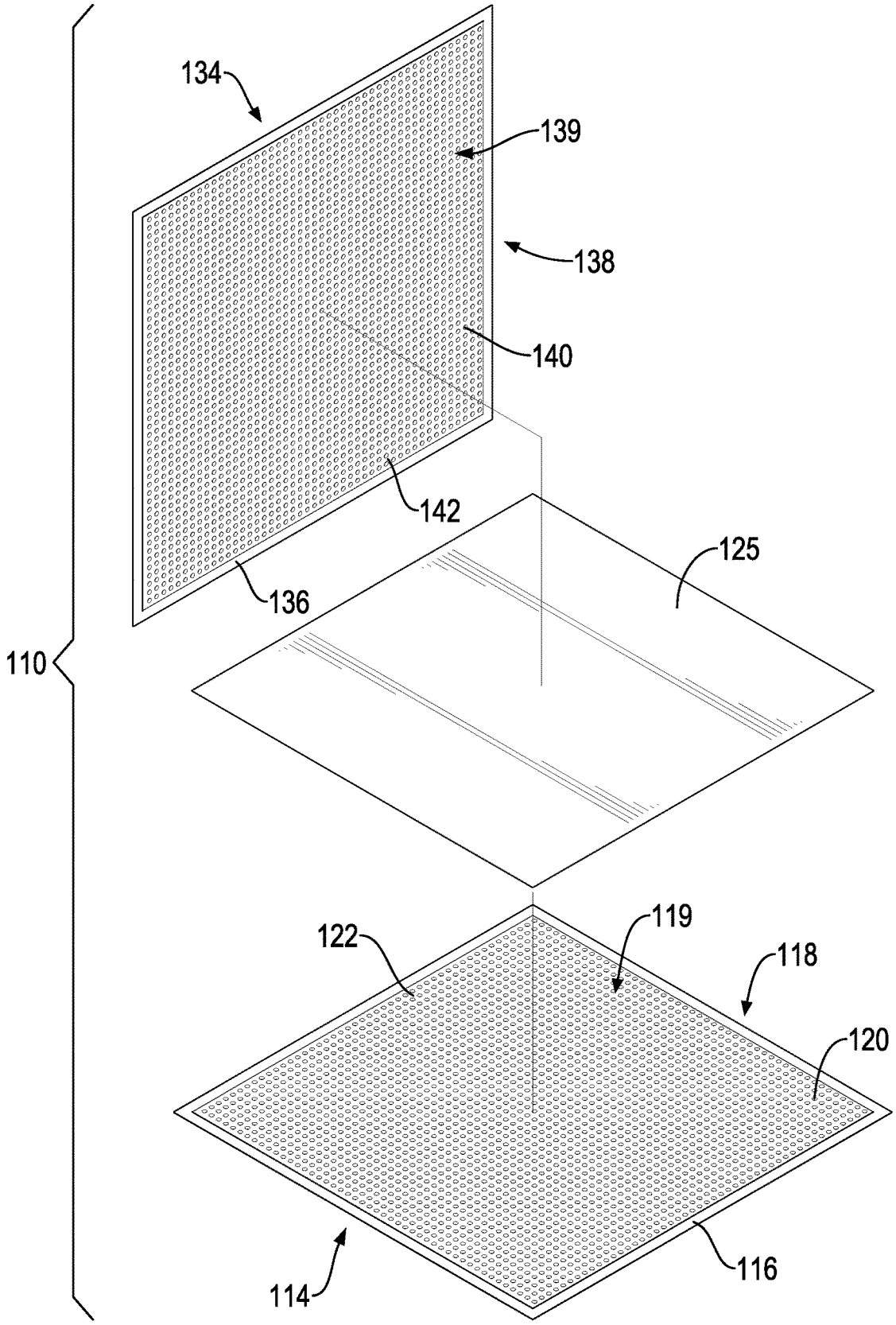
FIG. 2 is an exploded perspective view of the vapor chamber in FIG. 1.
Figure 3A:
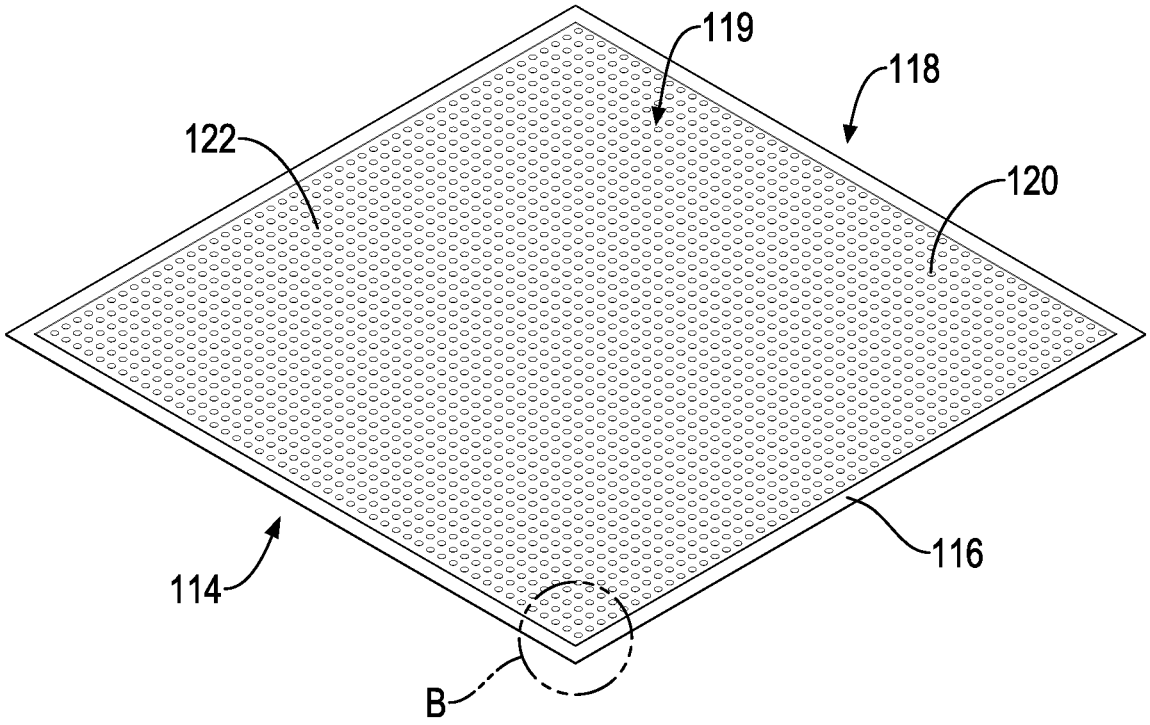
Figure 3B:
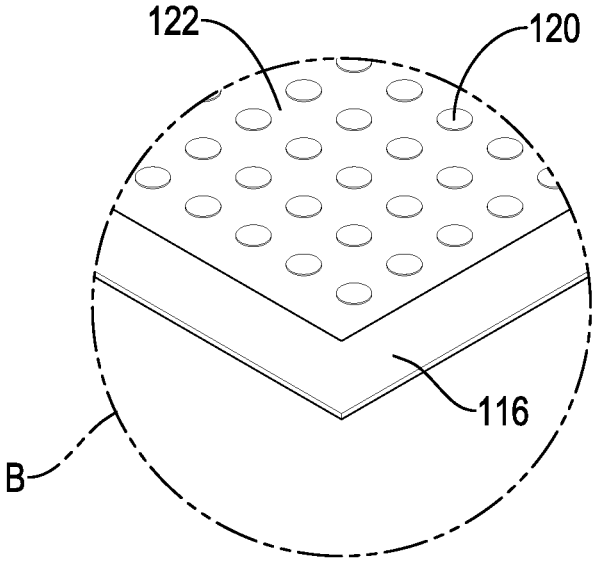
FIG. 3B is an enlarged perspective view of a corner section B of the lower casing in FIG. 3A.

With reference to FIGS. 5, 6A, 6B, and 7, the vapor chamber 510 is also rectilinear in shape and comprises an upper casing 534, a lower casing 114, and a wick structure 125 disposed therebetween. In the embodiment, the upper casing 534 is different from that of the embodiment of the vapor chamber 110 as shown in FIG. 2. Correspondingly, a first surface 532 and a second surface 538 of the upper casing 534 are also respectively different. As the lower casing 114 and the wick structure 125 in the embodiment of the vapor chamber 510 are the same as those of the vapor chamber 110, detailed description thereof will not be repeated for conciseness and brevity. Similar to the previous embodiments, the second surface 538 comprises a heat exchange chamber area 539 surrounded by walls having a flat rim 536. The heat exchange chamber area 539 is rectilinear in shape and comprises multiple upper surface features 540 therein, separated by multiple vapor areas 542.

In the embodiments, the heat exchange chamber areas 539, 119 of the second surfaces 538, 118 of the upper and lower casings 534, 114 form an airtight vacuum chamber having the wick structure 125 disposed therebetween and a working substance therein.

Figure 7A:
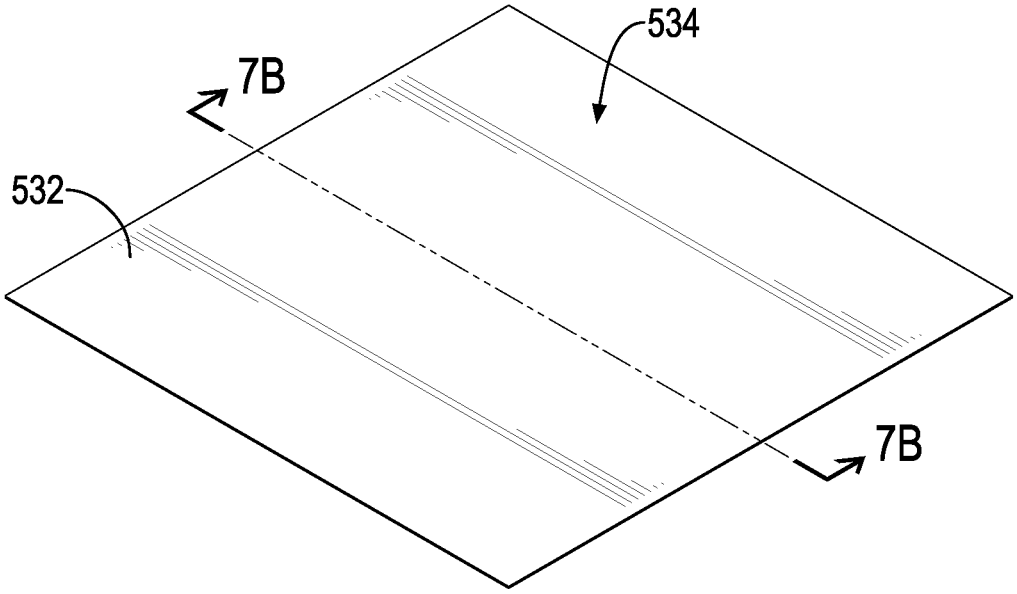
FIG. 7A is a perspective view of the vapor chamber in FIG. 5.
Figure 7B:
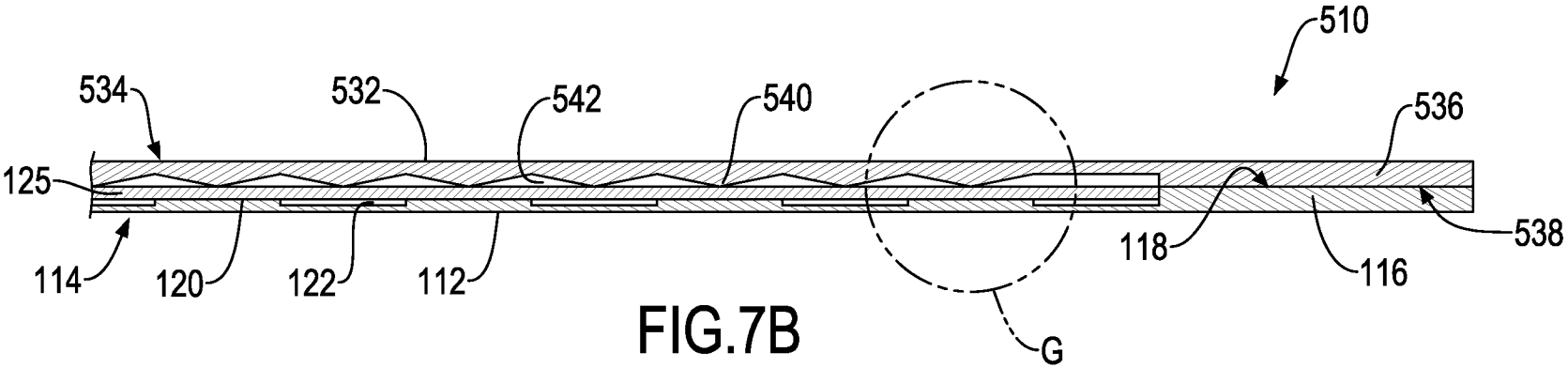
FIG. 7B is a cross sectional side view of the vapor chamber along the line 7B-7B in FIG. 7A.
Figure 7C:
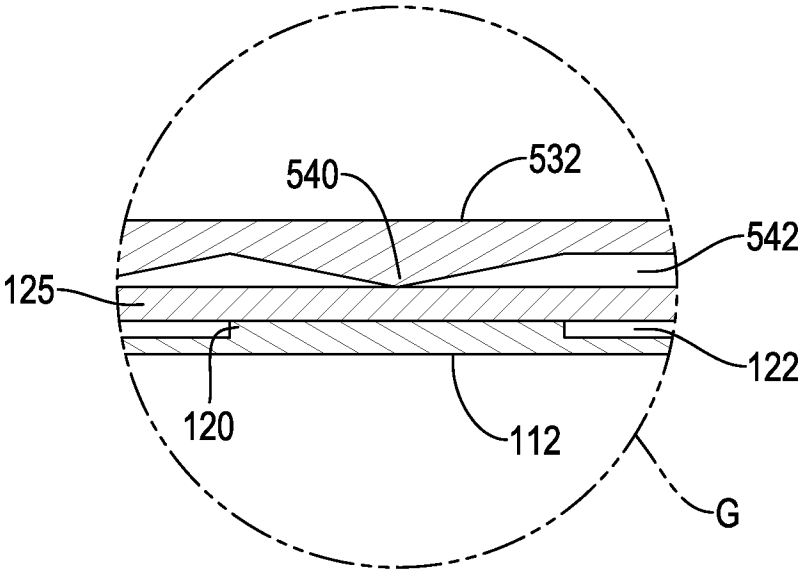
FIG. 7C is an enlarged cross sectional side view of a section G of the vapor chamber in FIG. 7B.

With further reference to FIGS. 7A to 7C, the upper and lower casings 534, 114 of the vapor chamber 510 form a seamless airtight sealed connection at the flat rims 536, 116 of the surrounding walls of the heat exchange chamber areas 519, 119, respectively. In the embodiments the outer and inner edges and walls of the upper and lower casings 534, 114 are aligned flush.

In the embodiment, the shape and size of the upper and lower surface features 540, 120 and corresponding vapor areas 542, 122 of the upper and lower casings 534, 114 are different. In the embodiment, the upper surface features 540 are evenly distributed triangular prisms and the lower surface features 120 are evenly distributed columns. The bases of the triangular prisms are the same size, and have a dimension less than the width of the flat rims 536, 116 of the surrounding walls of the heat exchange chamber area 539, 119, respectively, but larger than the diameter of the columns of the plurality of lower surface features 120. The diameters of the columns are the same size and are less than the width of the flat rims 536, 116 of the surrounding walls of the heat exchange chamber areas 539, 119, respectively. Similar with previous embodiments, the height of the upper surface features 540 of the upper casing 534 is in line with and along a same surface plane as the flat rim 536 of the surrounding walls of the heat exchange chamber area 532 and the height of the lower surface features 120 of the lower casing 114 is not. In the embodiment, the wick structure 125 is positioned within the heat exchange chamber area 119 of the lower casing 114 and a top surface thereof is in line with and along a same surface plane as the flat rim 116 of the surrounding walls of the heat exchange chamber area 119. Correspondingly, the height of the lower surface features 120 of the lower casing 114 is less than a lateral surface plane of the flat rim 116 and is equal to the height of the surrounding walls of the heat exchange chamber area 119 minus the thickness of the wick structure 125. In the embodiment, the wick structure 125 sits flatly upon the lower surface features 120 of the lower casing 114 with its periphery walls lying flush with the surrounding walls of the heat exchange chamber area 119. In the embodiment, the working substance is disposed within the vapor area 122 of the lower casing 114.

In the embodiment, a high heat flux source is applied to the first surface 112 of the lower casing 114 of the vapor chamber 510 and vaporizes the working substance. The vapor spreads throughout the entire internal volume of the plurality of vapor areas 542, 122 and condenses over cooler surfaces such as the inner walls of the second surface 538 of the upper casing 534. A wick structure 525 sits flatly upon the lower surface features 120 of the lower casing 114 with its periphery walls lying flush with the surrounding walls of the heat exchange chamber area 119, pumping the condensed fluid back to the heat flux source via capillary action.

The vapor chamber 510 is a rectangular, highly effective, and two-dimensional heat spreader with effective thermal conductivities. The upper casing 534 increases the area of the cooling surfaces for effective spreading of heat via the phase change (liquid-vapor-liquid) mechanism. Additionally, the plurality of upper and lower surface features 540, 120 of the upper and lower casings 534, 114 not only function as structural supports which hinder the deformation of the first surfaces 532, 112, respectively or leakage between the flat rims 536, 116 of the surrounding walls of the heat exchange chamber areas 539, 119, which cause dry-out, they also function as backflow accelerators or arteries, accelerating backflow velocity of the condensed liquid to the wick structure 125 and working liquid via increased surface area. The tips of the triangular prisms of the upper surface features 540 of the upper casing 534 contact the wick structure 125 and form a 'V' structure having two angled sides to accelerate backflow velocity of the condensed liquid. Also, in addition to the spaces between the 'V'-shaped vapor areas 542, the vapor areas 542 also comprise multiple parallel channels, evenly distributed, perpendicular to the triangular prisms from one wall of the heat exchange chamber area 539 to an opposite wall for increasing vapor area and vapor flow and condensation. The triangular prisms forming grooved structures 'V' and vapor areas are separated by the parallel channels, improving axial and radial heat transfer, while also enhancing the capillary loop between the condensation and evaporation surfaces. Lastly, the wick structure 125 is positioned in the middle of the vapor chamber 110 to further mitigate dry-out by facilitating the flow of the condensed liquid back to the evaporation surface, keeping it wet for large heat fluxes. Because the backflow velocity of the working substance is increased by the plurality of upper and lower surface features 540, 120, in addition to hindrance of deformation and leakage, and positioning and functioning of the wick structure 125 to further facilitate flow of the condensed liquid back to the evaporation surface, all assisting to mitigate dry-out, the heat-transmitting efficiency of the vapor chamber 510 is increased.

In the embodiments, not only can the shape and size of the lower surface features 140, 120 and corresponding vapor areas 142, 122 of the upper and lower casings 134, 114 be similar, or, the shape and size of the upper surface features 340 and corresponding vapor areas 342 of the upper casing 534 be different, the shape and size of the lower surface features and corresponding vapor areas of the lower casing can also be different. Accordingly, the embodiments can encompass any combination of shapes, sizes and geometries for the upper and lower surface features and corresponding vapor areas of the upper and lower casings.

Figure 8:
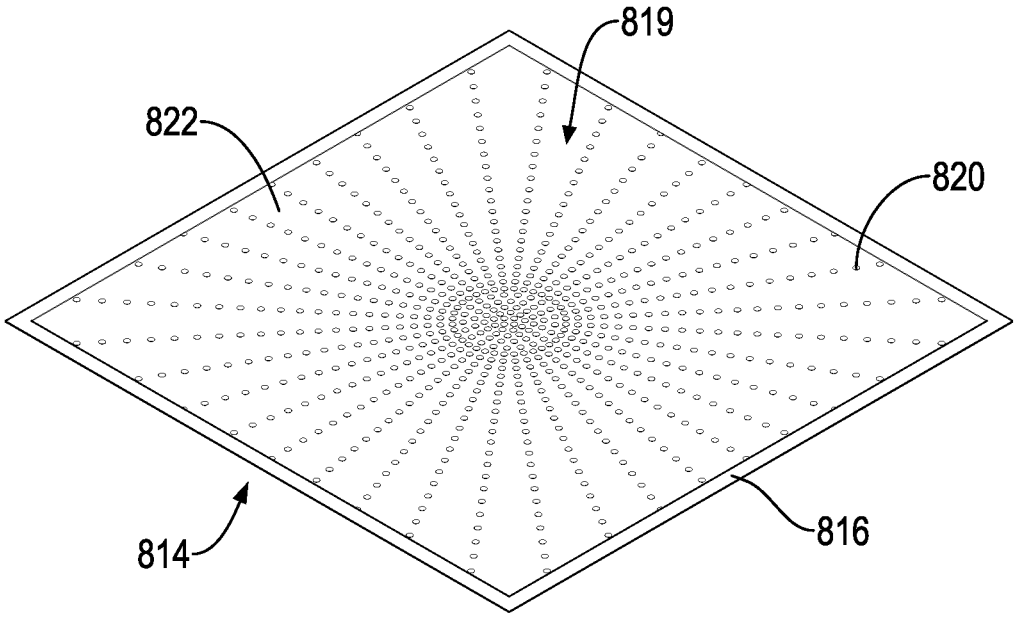
FIG. 8 is a perspective view of another embodiment of a lower casing for a vapor chamber in accordance with the present invention.

With reference to FIG. 8, the lower surface features 820 are columns evenly distributed in a radial pattern. The radial spacing of the vapor areas 822 gradually increases, the further the vapor areas 822 away from the center of the heat exchange chamber area 819 to the outer walls thereof. Accordingly, the lower surface features 820 are most densely arranged, closest to the heat flux source. The diameters of the columns are the same size, and are less than the width of the flat rim 816 of the surrounding walls of the heat exchange chamber area 819. In an embodiment, the wick structure 125 is positioned within the heat exchange chamber area 819 of the lower casing 814 and a top surface thereof is in line with and along a same surface plane as the flat rim 816 of the surrounding walls of the heat exchange chamber area 819. Correspondingly, the height of the lower surface features 820 of the lower casing 814 is less than a lateral surface plane of the flat rim 816, and is equal to the height of the surrounding walls of the heat exchange chamber area 819 minus the thickness of the wick structure 125. In the embodiment, the wick structure sits flatly upon the lower surface features 820 of the lower casing 814 with its periphery walls lying flush with the surrounding walls of the heat exchange chamber area 819. In the embodiment, the working substance is disposed within the vapor area 822 of the lower casing 814.

Figure 9:
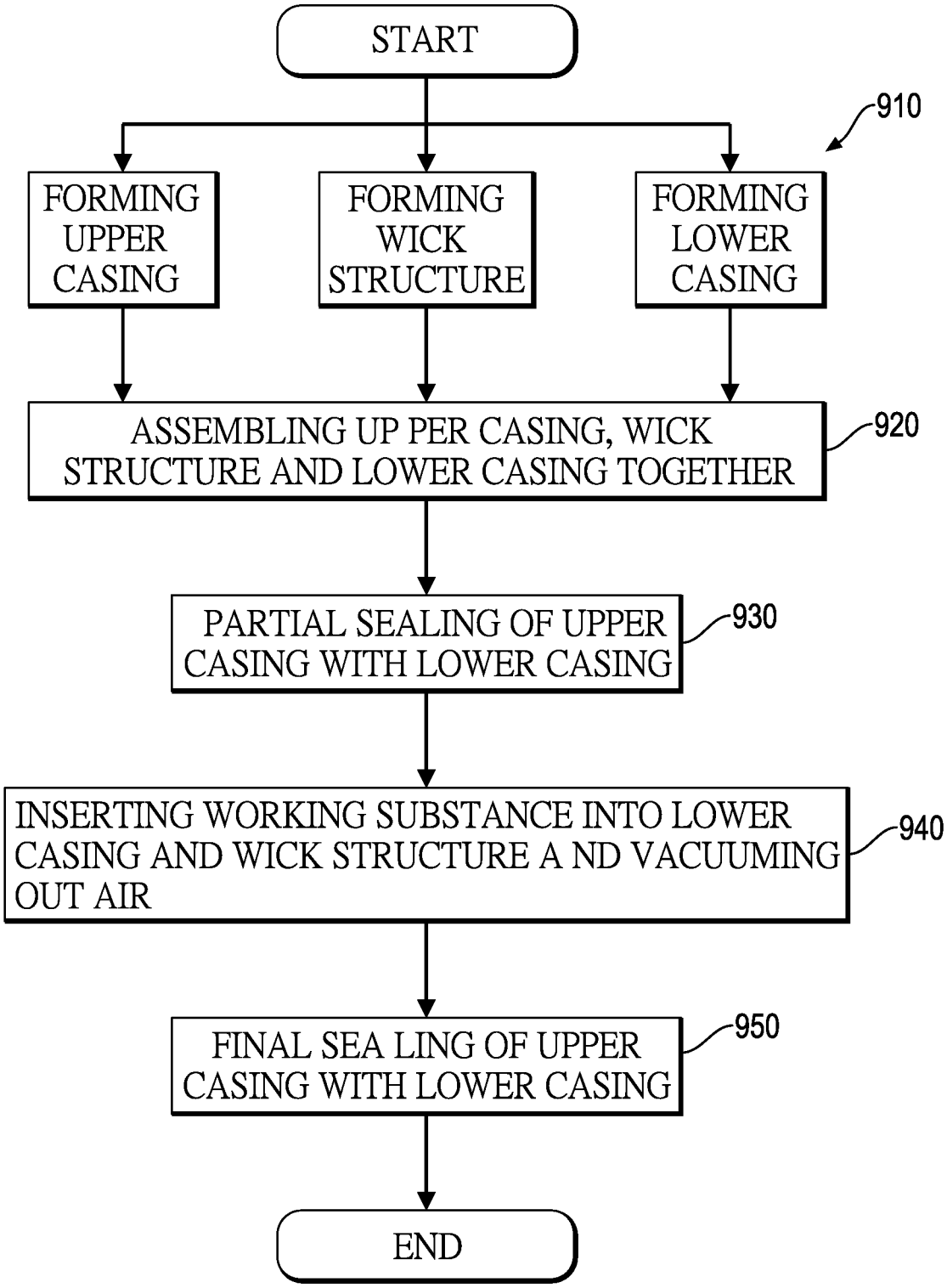
FIG. 9 is a flow chart of a manufacturing method of a vapor chamber in accordance with the present invention.

With reference to FIG. 9. a method for manufacturing a vapor chamber according to various embodiments comprises: Step (910): forming an upper casing having a first surface and a second surface having a heat exchange chamber area therein surrounded by walls having a flat rim; forming a lower casing having a first surface and a second surface having a heat exchange chamber area therein surrounded by walls having a flat rim; arranging and forming multiple lower surface features separated by multiple vapor areas in the heat exchange chamber area; arranging and forming multiple upper surface features separated by multiple vapor areas in the heat exchange chamber area of the upper casing; and forming a wick structure. Next, in Step (920): the upper casing, wick structure, and lower casing are assembled together. Following, in Step (930): the upper casing is partially sealed with the lower casing. After, in Step (940): a working substance is inserted into the lower casing and wick structure and air is pumped away from the plurality of vapor areas to form an airtight vapor chamber. Thereafter, in Step (950): the upper casing is finally sealed with the lower casing.

Those of ordinary skill in the relevant art can readily appreciate that in alternative embodiments, further heat treatment processes can be employed throughout the manufacturing method of the vapor chamber, and the embodiments are not limited to those described. Additionally, those skilled in the relevant art will appreciate that additional steps can be added to the process in order to incorporate additional features into the finished product. Also, the steps can be altered depending upon different requirements.

In the embodiments, the vapor chamber can be fastened to a processing unit by any suitable fastening means such as soldering, brazing or by means of thermal paste combined with glue. Alternatively, other fastening means can be provided for ensuring direct thermal contact between the free surface of the processing unit and the vapor chamber.

As CPUs and other processing units become lighter, smaller, and more powerful, generating more heat in smaller spaces, it becomes more difficult for vapor chambers to effectively spread heat via the phase change (liquid-vapor-liquid) mechanism, while concurrently not sacrificing maximum heat transport capacity, resulting in deformation of outer surfaces and resulting in leakage, all of which can cause dry-out.

The embodiments of the invention provide a vapor chamber, under vacuum, having a working substance therein, comprising upper and lower casings and a wick structure disposed therebetween. The upper and lower casings have upper and lower heat exchange chamber areas comprising multiple upper and lower surface features thereon, separated by multiple upper and lower vapor areas therebetween, respectively. The upper and lower heat exchange chamber areas are surrounded by walls, having upper and lower flat rims, respectively. The height of the upper surface features is greater than the height of the lower surface features, whereby a top surface of the wick structure lies flush with the lower flat rim. The upper and lower heat exchange chamber areas form a vacuum chamber. A seamless airtight sealed connection is formed at the upper and lower flat rims of the surrounding walls of the upper and lower heat exchange chamber areas.

In the embodiments, the upper casing increases the area of the cooling surfaces for effective spreading of heat via the phase change (liquid-vapor-liquid) mechanism. Additionally, the upper and lower surface features of the upper and lower casings not only function as structural supports which hinder the deformation of the first surfaces, respectively, keep a smooth plane, and/or hinder leakage between the flat rims of the surrounding walls of the heat exchange chamber areas, they also function as backflow accelerators or arteries, accelerating backflow velocity of the condensed liquid to the wick structure and working liquid. A plurality of triangular prisms forming grooved structures 'V' and vapor areas, separated by the parallel channels, can also improve axial and radial heat transfer, while also enhancing the capillary loop between the condensation and evaporation surfaces. Lastly, the wick structure is positioned in the middle of the vapor chamber to further mitigate dry-out by facilitating the flow of the condensed liquid back to the evaporation surface keeping it wet for large heat fluxes. Because the backflow velocity of the working substance is increased by the plurality of upper and lower surface features, in addition to hindrance of deformation and leakage, and positioning and functioning of the wick structure to further facilitate flow of the condensed liquid back to the evaporation surface, all assisting to mitigate dry-out, the heat-transmitting efficiency of the vapor chambers of the embodiments is increased.

The details of the construction or composition of the various elements of the vapor chambers of the embodiments not otherwise disclosed are not believed to be critical to the present invention, so long as the recited elements pose the strength or mechanical properties needed for them to perform as disclosed. Additional details of construction are believed to be well within the ability of one of ordinary skill in the art.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A vapor chamber, having a working substance therein, comprising:

an upper casing having a first surface and an opposite second surface, wherein the second surface comprises an upper heat exchange chamber area having multiple upper surface features thereon separated by multiple upper vapor areas, surrounded by walls having a flat rim;

a lower casing having a first surface and an opposite second surface, wherein the second surface comprises a lower heat exchange chamber area having multiple lower surface features thereon separated by multiple lower vapor areas, surrounded by walls having a flat rim; and a wick structure disposed between and in contact with the upper surface features and the lower surface features of the upper casing and the lower casing, respectively, wherein the upper and lower heat exchange chamber areas form a chamber having the wick structure disposed therebetween and the working substance therein and an airtight sealed connection is formed at the flat rims of the surrounding walls of the upper and lower heat exchange chamber areas.

2. The vapor chamber of claim 1, wherein the first surface of the lower casing is adapted to be in contact with a heat source.

3. The vapor chamber of claim 2, wherein a height of the upper surface features is greater than a height of the lower surface features, whereby a top surface of the wick structure lies flush with the flat rim of the surrounding walls of the lower heat exchange chamber area.

4. The vapor chamber of claim 1, wherein a largest diameter of the upper surface features and lower surface features is less than a width of the flat rims of the upper casing and the lower casing.

5. The vapor chamber of claim 1, wherein at least one of the lower surface features is arranged opposite to at least one of the upper surface features.

6. The vapor chamber of claim 1, wherein the lower surface features are columns distributed in a radial pattern to form a radial spacing of the vapor areas between the columns so as to gradually increase the vapor areas from the center of the lower heat exchange chamber area to the outer walls thereof.

7. The vapor chamber of claim 1, wherein the upper surface features are triangular prisms having a 'V' structure comprising two angled sides, and wherein each consecutive triangular prism is separated by a space.

8. The vapor chamber of claim 7, wherein the upper surface features further comprise multiple parallel channels, perpendicular to the triangular prisms, disposed from one wall of the upper heat exchange chamber area to an opposite wall thereof.

9. The vapor chamber of claim 1, wherein the upper surface features and the lower surface features are posts, supports, poles, columns, pillars, protrusions, bulges, bumps, protuberances, textured surfaces, segmented elements, or staggered elements, or any combination thereof, respectively.

10. The vapor chamber of claim 1, wherein the upper vapor areas and the lower vapor areas are posts, one or more of channels, canals, passageways, paths, networks, ducts, gutters, grooves, furrows, troughs, trenches, culverts, cuts, spillways, ditches, drains or conduits, or any combination thereof, respectively.

11. A method of manufacturing a vapor chamber, having a working substance therein, comprising:

Step (910): forming an upper casing having a first surface and an opposite second surface having an upper heat exchange chamber area therein surrounded by walls having a flat rim and forming a lower casing having a first surface and an opposite second surface having a lower heat exchange chamber area therein surrounded by walls having a flat rim, and forming a wick structure, wherein forming the upper casing further comprises arranging and forming multiple upper surface features separated by multiple upper vapor areas in the upper heat exchange chamber area, and wherein forming the lower casing further comprises arranging and forming multiple lower surface features separated by multiple lower vapor areas in the lower heat exchange chamber area;

Step (920): assembling the upper casing, the wick structure, and the lower casing together;

Step (930): partially sealing the surrounded walls having flat rims of the upper and lower heat exchange chamber areas;

Step (940): inserting a working substance into the lower casing and the wick structure and pumping away air from the multiple upper and lower vapor areas; and Step (950): completely sealing the upper casing with the lower casing, wherein the upper and lower heat exchange chamber areas form a chamber having the wick structure disposed therebetween and the working substance therein and an airtight sealed connection is formed at the flat rims of the surrounding walls of the upper and lower heat exchange chamber areas.

12. The method of claim 11, wherein the first surface of the lower casing is adapted to be in contact with a heat source.

13. The method of claim 11, wherein a height of the upper surface features is greater than a height of the lower surface features, whereby a top surface of the wick structure lies flush with the flat rim of the surrounding walls of the lower heat exchange chamber area.

14. The method of claim 11, wherein a largest diameter of the upper surface features and the lower surface features is less than a width of the flat rims.

15. The method of claim 11, wherein at least one of the lower surface features is arranged opposite to at least one of the upper surface features.

16. The method of claim 11, wherein the lower surface features are columns distributed in a radial pattern to form a radial spacing of the vapor areas between the columns so as to gradually increase the vapor areas from the center of the lower heat exchange chamber area to the outer walls thereof.

17. The method of claim 11, wherein the upper surface features are triangular prisms having a 'V' structure comprising two angled sides, and wherein each consecutive triangular prism is separated by a space.

18. The method of claim 17, wherein the upper surface features further comprise multiple parallel channels, perpendicular to the triangular prisms, disposed from one wall of the upper heat exchange chamber area to an opposite wall thereof.

19. The method of claim 11, wherein the upper surface features and the lower surface features are posts, supports, poles, columns, pillars, protrusions, bulges, bumps, protuberances, textured surfaces, segmented elements, or staggered elements, or any combination thereof, respectively.

20. The method of claim 11, wherein the upper vapor areas and lower vapor areas are posts, one or more of channels, canals, passageways, paths, networks, ducts, gutters, grooves, furrows, troughs, trenches, culverts, cuts, spillways, ditches, drains or conduits, or any combination thereof, respectively.

* * * * *